United States Patent [19]

Wenzel

[11] Patent Number: 4,575,940

[45] Date of Patent: Mar. 18, 1986

[54] REPLACEABLE BLADE KNIFE

[76] Inventor: Michael D. Wenzel, 2251 Clinton Ave., Apt. #E, Alameda, Calif. 94501

[21] Appl. No.: 711,589

[22] Filed: Mar. 13, 1985

Related U.S. Application Data

[63] Continuation of Ser. No. 172,200, Jul. 25, 1980, abandoned, which is a continuation-in-part of Ser. No. 175, Jan. 2, 1979, abandoned, which is a continuation-in-part of Ser. No. 931,556, Aug. 7, 1978, abandoned.

[51] Int. Cl.[4] ..... B26B 1/00

[52] U.S. Cl. ..... 30/335; 30/337; 30/338; 30/339

[58] Field of Search ..... 30/339, 337, 338, 335

[56] References Cited

U.S. PATENT DOCUMENTS

| | | | |
|---|---|---|---|
| 1,518,100 | 12/1924 | Nighbert | 30/339 |
| 1,563,674 | 12/1925 | Stuart | 30/339 |
| 1,813,782 | 7/1931 | Thompson | 30/337 |
| 1,827,509 | 10/1931 | Ericsson | 30/329 |
| 2,605,545 | 8/1952 | Weems | 30/337 |
| 2,853,778 | 9/1958 | Pratt et al. | 30/339 |
| 4,109,380 | 8/1978 | Anderson | 30/335 |

FOREIGN PATENT DOCUMENTS

| | | | |
|---|---|---|---|
| 960849 | 1/1975 | Canada | 30/339 |
| 605334 | 2/1926 | France | 30/339 |
| 885747 | 6/1943 | France | 30/339 |
| 127764 | 6/1919 | United Kingdom | 30/339 |

*Primary Examiner*—Frederick R. Schmidt
*Assistant Examiner*—J. T. Zatarga
*Attorney, Agent, or Firm*—Manfred M. Warren; Robert B. Chickering; Glen R. Grunewald

[57] ABSTRACT

A carpet layers knife made for easy replacement of a replaceable blade which includes a blade holding portion and a handle portion; the blade holding portion provided with an internal shoulder to guide the blade into and out of the knife without dulling the blade, and a connecting element holding the elements of the knife together, the connecting element being positioned to be out of the path of the blade as it is inserted and retracted but capable of holding the blade firmly in its tightened position while providing a passageway for insertion and removal of the blade in its loosened position.

9 Claims, 7 Drawing Figures

REPLACEABLE BLADE KNIFE

CROSS REFERENCE TO RELATED APPLICATION

This is a continuation, of application Ser. No. 172,200, filed July 25, 1980, now abandoned, which was a continuation-in-part, of application Ser. No. 000,175, filed Jan. 2, 1979, now abandoned which was a continuation-in-part of application Ser. No. 931,556 filed 8/7/78, which is now abandoned.

BACKGROUND OF THE INVENTION

The invention relates generally to knives with changeable blades and more particularly such knives used by carpet layers which include a handle and blade holder for demountably securing a heavy-duty, razor-style blade having two sharpened edges and an open center section for mounting the blade in the handle.

Carpet layers use a knife of this character for cutting and trimming during carpet installation. The carpet to be cut sometimes is heavy, necessitating a sharp blade and good leverage to cut along a precise outline. A substantial amount of cutting and trimming must be done even in carpeting a small room. Consequently, though heavy-duty blades are used, the blades quickly become dull and must be changed. In order to always have a sharp knife, a carpet layer should use about 15 blades in the course of a day's work.

The customary handle and blade holder has two half sections formed to receive and clamp the blade therebetween. The blade holder must be capable of holding the blade firmly against both longitudinal forces which tend to push the blade into the handle and torques which tend to rotate the blade. In many knives the screw that holds the sections together passes through the open center portion of the blade to apply the maximum compressive force to hold the blade tightly between the sections. In other knives of the prior art the blade is held firmly in position by projections extending through the open center of the blade or by in-turned flanges holding the edges of the blade. Though such blade-holding arrangements adequately secure the blade in position, they require complete removal of the clamping screw and disassembly of the knife half sections in order to change blades or to reverse the blade to expose a different edge, and then the sections must be reassembled. The process of disassembly and reassembly frequently even requires the use of a screw driver. The need to disassemble the knife to change or reverse the blade is inconvenient and time consuming. The effort and time loss involved in changing blades causes carpet layers to use blades beyond their sharp condition which further reduces working efficiency.

A serious problem in using known knives is the hazard presented by exposure to the extremely sharp blades. Spare blades are usually stored in a compartment formed in the handle sections of knives. Disassembly of the sections to change or reverse the blade necessarily opens the storage compartment, and the blades frequently spill from the storage compartment, exposing the sharp edges. Accidental injury due to handling of the blades is not uncommon in the carpet laying trade.

SUMMARY OF THE INVENTION

The present invention avoids or greatly reduces the above-mentioned problems. An object of the present invention is to provide a knife blade holder of the character described which is constructed so that only a slight loosening of the means for holding the sections together will permit sufficient separation of the blade-holding portions to define a passageway for quick and easy removal and insertion of a blade so that the blade in the knife holder may be readily removed and inverted or replaced without requiring disassembly of the handle sections and with no possibility of damage to the sharpened blade edge and with reduced hazard to the user.

Another object of the present invention is to provide a knife holder of the character described having a spare blade storage compartment in which the stored blades are positively retained against accidental discharge upon the aforementioned opening of the sections to withdraw and reinsert a blade.

The invention embraces a knife blade holder for a thin elongated blade having a sharpened longitudinally extending edge and an elongated open center portion having its long axis parallel to the sharpened edge. The knife blade holder of the present invention comprises two body sections, each having a handle portion and a blade-holding portion. The body sections are connected together by connecting means located adjacent the blade holding portions. The connecting means has a tightened position for clamping the blade between the blade-holding portions and a loosened position permitting separation of the blade-holding portions to define a passageway therebetween for insertion and withdrawal of the blade. The knife is provided with resilient means for urging the blade-holding portions apart when the connecting means is in its loosened position. One of the blade-holding portions has an internal elongated shoulder extending longitudinally in the aforementioned passageway and dimensioned to engage the blade open center portion to maintain the edge of the blade entirely within the passageway and to guide the blade longitudinally therethrough on insertion and withdrawal over a substantial length of the passageway. The other blade-holding portion has a channel for receiving the shoulder and a flat face for frictionally engaging the blade when the connecting means is in its tightened position.

DETAILED DESCRIPTION OF PREFERRED EMBODIMENTS

Figure 1:
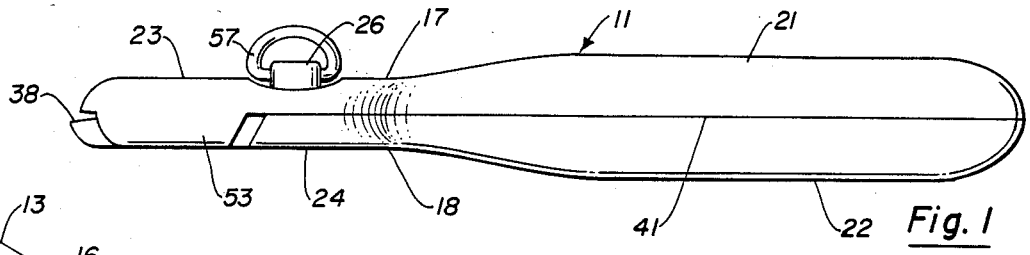
FIG. 1 is an edge elevation of a knife blade holder embodying the present invention.
Figure 2:
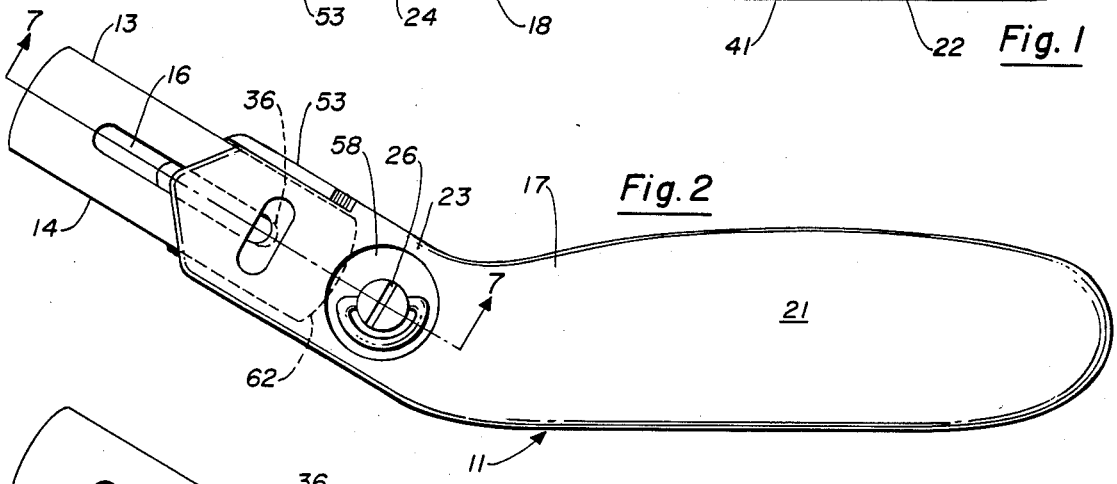
FIG. 2 is a side elevation of one side of the holder illustrated in FIG. 1.
Figure 3:
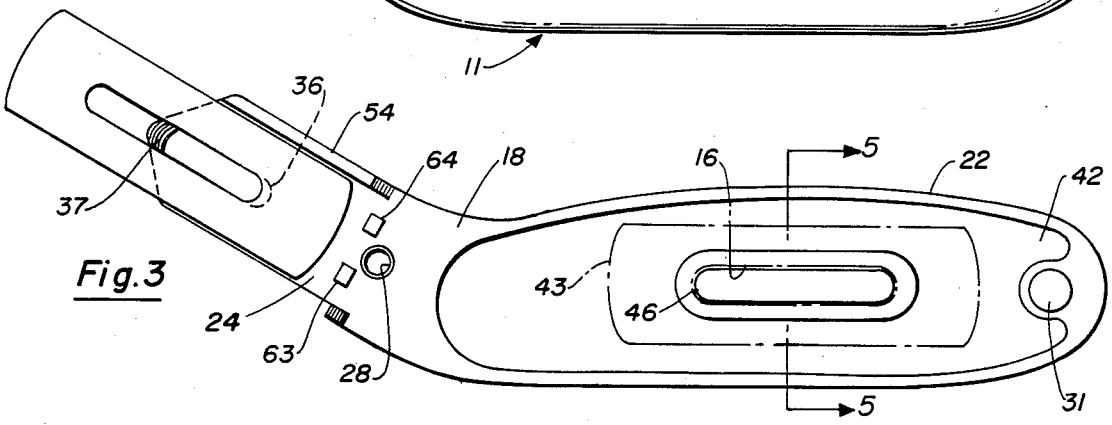
FIGS. 3 and 4 are side elevations of the interior configurations of the two sections of the holder illustrated in FIG. 1.

The knife blade holder generally designated 11 is adapted for use with a thin elongated blade 12 having sharpened longitudinally extending edges 13 and 14 and an elongated open center portion 16. The long axis of the open center portion 16 is parallel to edges 13 and 14. The holder comprises two body sections 17 and 18, respectively having handle portions 21 and 22, and blade-holding portions 23 and 24. Means 26 is provided for connecting the sections 17 and 18 together and is located adjacent the blade-holding portions 23 and 24. Connecting means 26 has a tightened position for clamping the blade 12 between the blade-holding portions 23 and 24 and a first loosened position permitting separation of the blade-holding portions to define a passageway 33 (FIG. 7) therebetween for insertion and withdrawal of the blade 12. To facilitate the formation of passageway 33, spring 61 is provided to urge the blade-holding portions 23 and 24 apart when connecting means 26 is in its first loosened position.

To guide blade 12 longitudinally through passageway 33 over a substantial length of the passageway on insertion and withdrawal and further to maintain the edges of blade 12 entirely within passageway 33 on insertion and withdrawal, blade-holding portion 24 is formed with an internal elongated shoulder 36 extending longitudinally in passageway 33 and dimensioned to engage the blade open center portion 16. The position of blade 12 during insertion can be seen in FIG. 7. The other blade-holding portion 23 is formed with a channel 50 for receiving shoulder 36 and with a flat face 51 for frictionally engaging blade 12 when connecting means 26 is in its tightened position. In addition to its guiding and positioning functions, shoulder 36 defines a seated position for blade 12, which is held securely in its seated position by the aforementioned frictional engagement with flat face 51.

To direct blade 12 onto shoulder 36 when being inserted into passageway 33, it has been found advantageous to provide a ramp 37 at the end of shoulder 36. Preferably also the end 38 of the other blade-holding portion 23 is ramped opposite the ramp 37 to cooperate therewith to form a guiding opening for the blade to enter into passageway 33. As a further feature to assist the user in inserting the blade, one of the aforementioned ends is formed to protrude beyond the other to provide a lip for supporting and positioning an end of blade 12 before insertion into the passageway. This embodiment shows ramp 37 elongated. Another aid assisting the user in the proper insertion of the blade is a sight opening 39 in portion 23 affording visual verification of the positioning blade 12 in passageway 33. Sight opening 39 is in elongated form registering with and extending perpendicular to shoulder 36.

Figure 6:
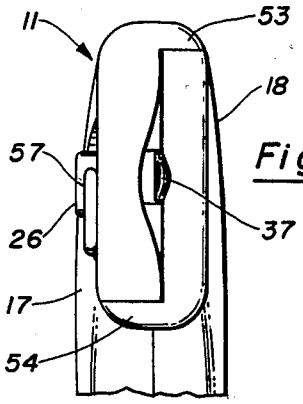
FIG. 6 is an enlarged fragmentary front end elevation of the holder illustrated in FIG. 1.

As an added safety feature, blade holding portions 23 and 24 may respectively include side flanges 53 and 54 dimensioned to provide a side wall for passageway 33 and positioned or offset sufficiently far from shoulder 36 to accomodate unimpeded motion and play of blade 12 as it is inserted into and withdrawn from the passageway. This can best be een in FIG. 6. The side flanges 53 and 54 are provided to prevent the sharpened edges 13 and 14 of blade 12 from inadvertantly and unexpectedly projecting through the sides of passageway 33 in the event of malfunctioning or improper operation of the device. Flanges 53 and 54 are positioned far enough from shoulder 36 so tht when blade 12 is inserted into the passageway and guided by shoulder 36, sharpened edges 13 and 14 will not touch the flanges, thereby preventing damage to the blade edges and injury to the user.

Connecting means 26 may comprise, as shown here, a screw mounted through an opening 27 in section 17 and threaded into an aligned opening 28 in section 18. The resilient means for urging the separation of the sections may then comprise a spring 61, e.g., helical or butterfly, surrounding screw 26 and mounted in compression between the confronting inside surfaces of the sections. The shank of screw 26 is provided with some clearance in opening 27 in section 17; this clearance, cofunctioning with spring 61, enables the spring to act as a fulcrum about which the sections may articulate in their longitudinal planes. Thus, manual compressive gripping of the handle portions in the loosened position of screw 26 will automatically produce a separation of the blade holding portions 23 and 24 for ready insertion and removal of blade 12.

To obviate the need for additional tools, such as a screw driver, to change blades, connecting means 26 is provided with a manually engageable extension, such as D-ring 57 for applying torque to screw 26. The head of screw 26 may have a rubberized backing on its bottom surface facing body section 17, or equivalently the shank of screw 26 may be inserted through a rubber O-ring which is partially set in a recess in the bottom of the screw head, to hold connecting means 26 firmly in its tightened position.

Figure 7:
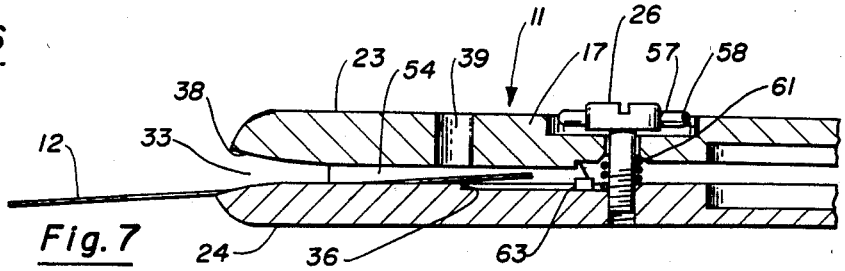
FIG. 7 is a fragmentary enlarged cross-section taken on the plane of line 7—7 of FIG. 2.

If connecting means 26 protrudes from the body section too far it tends to snag or catch on carpeting. However, if it does not protrude far enough it cannot be operated without a tool. In one embodiment of this invention screw head 56 is set in a recessed portion 58 in body section 17. D-ring 57 is connected to connecting means 26 so that it may stand upright as in FIG. 1 or it may lie in recess 58 as in FIG. 7. Its position in FIG. 1 is used for loosening and tightening of the connecting means 26 while its position in FIG. 7 is used for triming carpet.

An abuttment in the form of a pair of shoulders 63 and 64 is formed as an integral part of body section 18 adjacent to screw 26 and in position to act as an indexing stop for the inner end 62 of blade 12 with the latter mounted in seated position registering the opening 16 therein with the shoulder 36 on blade-holding portion 24.

Figure 4:
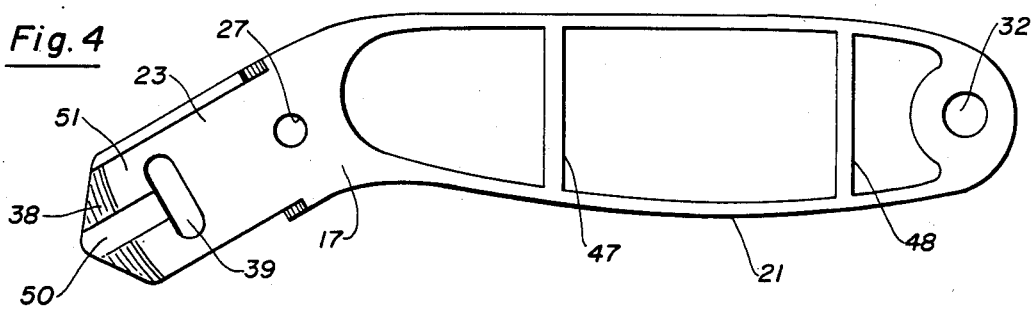
Figure 5:
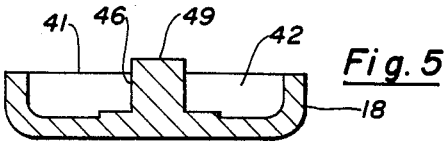
FIG. 5 is an enlarged cross-section taken on the plane of line 5—5 of FIG. 3.

As will be observed from the drawings, sections 17 and 18 are formed for parting along a medial longitudinally extending plane, see parting line 41 in FIG. 1, and one of the handle portions 22 is formed with a recess 42, dimensioned to receive and store a plurality of spare blades 43. A shoulder or stud 46 is mounted centrally of recess 42 and is dimensioned for mounting through the blade open portions 16 for confining the transverse movement of the blades to within the area of the recess. It is most important that the transverse movement of the blades be confined to prevent contact of the sharpened blade edges with the inner surfaces of handle portions 21 and 22, thereby preventing nicking or dulling the sharp edges. As an additional safety feature of the present invention, shoulder 46 has a height extending across the plane of separation of the sections, see FIG. 5, for retention of blades thereon upon separation of the blade-holding portions for insertion and removal of a blade. Accordingly, when the sections are separated to withdraw and insert a blade, all of the blades 43 in the storage compartment are positively retained against accidental escape. To assist in this regard, ribs 47 and 48 are provided on handle portion 21, as seen in FIG. 4, positioned substantially at the plane of separation and for engagement of blades 43 mounted on shoulder 46 to prevent movement of the blades from the upper end 49 of shoulder 46 upon separation of the blade holding portions of the sections.

When the blade knife holder of the present invention is formed with a blade storage compartment in the handle portions, it is advantageous to form the connecting means to permit rotation of the sections relative to one another when the connecting means is in a second loosened position, looser than the first loosened position defining passageway 33. In this way connecting means 26 may be loosened to its second loosened position, and body sections 17 and 18 may be rotated with respect to one another to expose the blade storage compartment. In this manner quick and easy access is provided to the blade storage compartment with no need for time-consuming disassembly of the body sections. For even greater convenience, the thread of screw 26 may be formed with a pitch permitting the connecting means to move from its tightened position to its first loosened position when the screw is advanced through about one revolution and further permitting the connecting means to move from its tightened position to its second loosened position when the screw is turned through about two revolutions. Thus, with one revolution of the screw passageway 33 is formed for insertion or withdrawal of blade 12, and with two revolutions of the screw the body sections 17 and 18 may be rotated to open the blade storage compartment.

It has been found convenient to provide a boss 31 projecting from the distall end of one of the handle portions, here portion 22, and a recess 32 in the other handle portion 21 for receiving boss 31. The boss is long enough to prevent relative rotation of the body sections when the connecting means is in its first loosened position, thereby preventing accidental misalignment of passageway 33 under the gripping action applied to the handle portions. The boss length, however, must be limited enough to permit the relative rotation of the body sections when the connecting means is in its second loosened position.

In operation, to reverse a blade to expose a new cutting edge, it is only necessary to loosen the connecting means, typically one revolution of the screw. The blade may be easily withdrawn from the passageway 33, being guided only by the elongated internal shoulder 36 contacting the blade open center portion 16. Guided in this manner, the sharpened blade edges 13 and 14 will contact no internal surfaces of the knife blade holder. Consequently, they will not become nicked or dulled. The blade is then reversed and then inserted into the passageway again, the leading edge of the blade being guided onto the shoulder 36 by the ramps 37 and 38. When the blade reaches its seated position, connecting means 26 is easily tightened, typically with one revolution of the screw, to clamp the blade securely between blade holding portions 21 and 22 against thrusts or torques exerted thereon during use.

What is claimed is:

1. A knife blade holder for a thin elongated blade having two sharpened longitudinally extending edges on opposed sides of said blade and an elongated open center portion having its longitudinal axis parallel to said edge, said holder comprising:

a first and a second body section, each having a handle portion and a blade-holding portion with each blade holding portion having a flange;

connecting means for connecting said sections together, said connecting means being located adjacent said blade-holding portions and having a tightened position for clamping said blade between said blade-holding portions and a first loosened position permitting separation while still connected together of said blade holding portions to define a passageway therebetween said passageway having one open end for slidable insertion and withdrawal of said blade into and out of said passageway and with said flanges forming walls which at least partly enclose said passaeway;

said first blade-holding portion having a first ramped end at the opening of said passageway, a lip extending beyond said second blade holding portion and an internal elongated shoulder extending longitudinally in said passageway, said shoulder being ramped to blend smoothly with said first ramped end and dimensioned to engage said blade open center portion and positioned to hold the edges of said blade out of dulling contact with the walls of said passageway during insertion and withdrawal of said blade, said shoulder also formed to hold the edges of said blade out of dulling contact with the walls of said passageway when force is applied to said blade while work is performed with said blade; and said second blade-holding portion having a second ramped end at the opening of said passageway, a channel for receiving said shoulder when said connecting means is in tightened position and a flat face for frictionally engaging said blade when said connecting means is in said tightened positioned.

2. The holder defined in claim 1, further including:

said second blade-holding portion being formed with a sight opening opposed to said shoulder affording visual verification of the positioning of said blade in said passageway on sliding insertion and withdrawal.

3. The holder defined in claim 1, wherein said connecting means comprises:

a screw connected to one of said sections; and a spring surrounding said screw and mounted in compression between said sections.

4. The holder defined in claim 1, further including:

an abutment on one of said blade-holding portions positioned to limit the insertion of said blade into said passageway.

5. The holder defined in claim 1, further including:

said sections being formed to part along a medial longitudinally extending plane;

one of said handle portions being formed with a recess dimensioned to receive at least one of said blades and also formed with a second shoulder centrally of said recess;

said second shoulder being dimensioned for mounting through said blade open center portion for confining the transverse movement of said blade to within the area of said recess; and said second shoulder having a height extending across said plane for retention of a blade thereon upon separation of said blade-holding portions for insertion and withdrawal of said blade.

6. The holder defined in claim 5, further including:

retaining means formed on the other of said handle portions, positioned substantially at said medial plane for engagement with a blade mounted on said second shoulder and for retention of said last-named blade on said second shoulder upon separation of said ends.

7. The holder defined in claim 5, wherein:

said connecting means is formed to permit rotation of said sections relative to one another when said connecting means is in a second loosened position.

8. The holder defined in claim 7, wherein said connecting means comprises:

a screw carried by one of said sections and connected to the other of said sections;

a spring surrounding said screw and mounted in compression between said sections; and the thread of said screw being formed to have a pitch permitting said connecting means to move from said tightened position to said first loosened position when said screw is turned through about one revolution, and from said tightened position to said second loosened position when said screw is turned through about two revolutions.

9. The holder defined in claim 7, further including:

one of said handle portions having a boss at its distal end;

the other of said handle portions having a recess for receiving said boss; and said boss having a height preventing said rotation when said connecting means is in said first loosened position and permitting said rotation when said connecting means is in said second loosened position.

* * * * *